US006183279B1

(12) United States Patent
Murakami et al.

(10) Patent No.: US 6,183,279 B1
(45) Date of Patent: Feb. 6, 2001

(54) LOW COUPLING FORCE CONNECTOR ASSEMBLY

(75) Inventors: Takao Murakami; Masaru Fukuda, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/506,088

(22) Filed: Feb. 17, 2000

(30) Foreign Application Priority Data

Feb. 19, 1999 (JP) ..... 11-041658

(51) Int. Cl.[7] ..... H01R 13/62
(52) U.S. Cl. ..... 439/157; 439/347
(58) Field of Search ..... 439/157, 347, 439/310, 372, 152, 155

(56) References Cited

U.S. PATENT DOCUMENTS

| | | | | |
|---|---|---|---|---|
| 4,352,533 | | 10/1982 | Murase et al. . | |
| 5,871,363 | * | 2/1999 | Kimura | 439/157 |
| 5,888,080 | * | 3/1999 | Maejima | 439/157 |
| 5,957,709 | * | 9/1999 | Heimuller et al. | 439/157 |
| 6,045,375 | * | 4/2000 | Aoki et al. | 439/157 |
| 6,062,882 | * | 5/2000 | Hanazaki et al. | 439/157 |

FOREIGN PATENT DOCUMENTS

| | | |
|---|---|---|
| 54-95894 | 12/1977 | (JP) . |
| 55-60284 | 5/1980 | (JP) . |
| 1-159978 | 6/1989 | (JP) . |

* cited by examiner

*Primary Examiner*—Brian Sircus
*Assistant Examiner*—Phuong KT Dinh
(74) *Attorney, Agent, or Firm*—Armstrong, Westerman, Hattori, McLeland & Naughton

(57) ABSTRACT

A low coupling force connector assembly consists of a first connector having a housing with sub connectors fixed therein, second connectors each with a boss means, and a first and second sliders each with a cam groove for guiding the boss to fit the second connectors to the sub connectors. The first and second sliders are longitudinally slidable relative to each other between a telescopically-expanded position and a telescopically-contracted position and, in the expanded position, inserted laterally into the housing of the first connector. The first slider, with the cam groove of the first and second sliders engaged with the boss, is pushed to the contracted position to make the second slider follow the first slider into the housing, whereby to fit the second connectors to the sub connectors at staggered times.

8 Claims, 6 Drawing Sheets

LOW COUPLING FORCE CONNECTOR ASSEMBLY

BACKGROUND OF THE INVENTION

1. Field of the Invention

This invention relates to a low coupling force connector assembly in which to one connector (e.g. female connector) are fitted a plurality of other connectors (e.g. male connectors) at staggered times with a slider and, more particularly, to a low coupling force connector assembly which enables to-downsize the slider, but yet requires a reduced force for operating the slider.

2. Description of the Related Art

There has conventionally been used a low coupling force connector assembly in which a plurality of male connectors are driven at staggered times and fitted to an integral-type female connector by means of a slider.

For example, a low coupling force connector assembly as shown in FIGS. 7A and 7B has been proposed in Japanese U.M. Application Unexamined Publication No. 54-95894.

In FIG. 7A, the low coupling force connector assembly 100 consists of an integral-type female connector 110, five male connectors 120A to 120E, and a slider 130 slidably mounted on the female connector 110 which, when operated, causes each male connector 120A to 120E to fit into the female connector 110 at staggered times.

As shown in FIG. 7B, the male connector 120A to 120E has a pair of bosses 121, 122 located on each side wall thereof, at different distances from the front end toward the female connector 110. The female connector 110 is formed in each major wall thereof with five pairs of straight guide slits 111, 112 for guiding the respective pairs of bosses 121, 122 of the male connectors 120A to 120E.

Reverting to FIG. 7A, the slider 130 is provided in each major wall thereof with five pairs of cam grooves 131, 132 which receive the bosses 121, 122 of the respective male connectors 120A to 120E and extend transversely to the respective guide slits 111, 112 of the female connector 110. The two cam grooves 131, 132 in each pair are of the same shape and have a slant portion at the same part thereof which has an effective drive stroke S.

The slant portion of the cam grooves 131, 132 is for driving the bosses 121, 122 of the male connector 120A to 120E when the slider 130 is operated. Because the forming positions of the slant portion are different for each pair of the cam grooves 131, 132, the movement of the slider 130 is transmitted to the bosses 121, 122 of each male connector 120A to 120E at staggered times.

In the thus constructed conventional low coupling force connector assembly 100, the slider 130 is assembled to the female connector 110 and its pairs of cam grooves 131, 132 are registered relative to the respective pairs of guide grooves 111, 112, and the bosses 121, 122 of each male connector 120A to 120E are introduced into the inlets of the respective pairs of guide grooves 111, 112 and of cam grooves 131, 132.

If in this condition the slider 130 is pushed in, the bosses 121, 122 of the male connectors 120A to 120E slide in succession along the respective guide grooves 131, 132 of the slider 130 to have the male connectors 120A to 120E fit to the female connector 110 at staggered times.

In the conventional low coupling force connector assembly 100, however, because all the pairs of cam grooves 131, 132 are formed in the same slider 130, it is necessary that the length of the effective drive stroke S for each cam groove 131, 132 be made equal to the entire cam-groove length L/number of male connectors. Consequently, the effective drive stroke S of each cam groove 131, 132 for driving the male connector 120A to 120E becomes short. To cope with this, it is necessary that the cam-constituting slant portion of each cam groove 131, 132 be formed at a steep angle, with the result that the load of coupling the male connectors 120A to 120E, i.e., the force required for operating the slider 130 becomes unfavorably large.

If the entire length of the slider 130 is made large, a wide space can be obtained on the slider 130 so that each cam groove 131, 132 is formed with a longer effective drive stroke S and at a less steep slant angle. In this case, however, there arises a drawback that the slider is upsized.

SUMMARY OF THE INVENTION

This invention has been accomplished to overcome the above drawbacks and an object of this invention is to provide a low coupling force connector assembly which provides cam grooves on a slider with a long effective drive stroke and at a less steep slant angle and reduces the force required for operating the slider, and which downsizes the slider.

In order to attain the object, according to this invention, there is provided a low coupling force connector assembly which comprises: a first connector having a housing with a plurality of sub connectors fixed therein; a plurality of second connectors, each having a boss means, corresponding to the sub connectors; and a first and second sliders, each having a cam groove means which guides therealong the boss means of a respective one or ones of the second connectors to fit the second connectors to the sub connectors, the first and second sliders, the latter inside the former, being longitudinally slidable relative to each other between a telescopically-expanded position and a telescopically-contracted position, wherein the first and second sliders, in the telescopically-expanded position, are inserted into the housing of the first connector from a direction traverse to a fitting direction of the first and second connectors, and the first slider, with the cam groove means of the first and second sliders engaged with the boss means of the second connectors, is pushed and moved to telescopically-contracted position so as to make the second slider follow the first slider into the housing, whereby to fit the second connectors to the sub connectors of the first connector at staggered times.

With the thus constructed low coupling force connector assembly, through the operation (pushing into the first connector housing) of the first slider, the related one or ones of the second connectors are first fitted to the first connector, and through the subsequent operation of the second slider, the remainder of the second connectors are fitted to the first connector at staggered times.

With such a low coupling force connector assembly, because a plurality of sliders (first and second sliders) are employed which are slidable relative to one another in a telescopic manner, a wide space can be secured on each slider for forming a cam groove means. As a result, the cam groove means can be formed with an elongated effective drive stroke for driving the boss means of the related second connector(s) and at a less-steep slant angle, leading to a reduced force required for operating the sliders.

Because it is arranged that the first and second sliders are operated at differed times, the second connectors are coupled with the respective sub connectors of the first connector at staggered times, also contributing to a reduction in the force required for operating the sliders.

Further, because the sliders are longitudinally slidable relative to one another and become shortened in a telescopic manner when pushed into the housing of the first connector, the sliders and thus the connector assembly can be downsized.

Incidentally, the number of sliders employed according to this invention is not limited to two (first and second sliders), but three or more sliders may be employed in a longitudinally-extendable (telescopic) manner relative to one another.

Preferably, the cam groove means of at least one of the first and second sliders comprises two or more cam grooves in a longitudinally-spaced arrangement.

Preferably, the two or more cam grooves are located at different distances from an end in a width direction of the related slider or sliders toward the second connectors, and the boss means of the second connectors are correspondingly located at different distances from ends of the related second connectors toward the first connector.

Preferably, the two or more cam grooves are located closer to the end in the width direction of the related slider or sliders in order of proximity to a proximal end of the related slider or sliders.

Preferably, the two or more cam grooves slant at slant angles which become steeper in order of proximity to a proximal end of the related slider or sliders.

Preferably, at least one of the first and second sliders has a cutout formed therein at a position corresponding to the cam groove means of the other slider to avoid interference of the one slider with the boss means of one of the second connectors during its sliding along the cam groove means of the other slider.

Advantageously, one of the first and second sliders has a projection means, and the other slider has a corresponding slide groove means in which the projection means slides to move the first and second sliders relative to each other within limits of an entire length of the cam groove means.

According to another aspect of this invention, there is provided a low coupling force connector assembly which comprises: a first connector having a housing with a plurality of sub connectors fixed therein; a plurality of second connectors, each having an upper and lower bosses projecting thereon, corresponding to the sub connectors; and a first and second sliders, each having a pair of opposed slider plates with one or more pairs of opposed cam grooves formed thereon, the cam grooves guiding therealong the bosses of a respective one or ones of the second connectors to fit the second connectors to the sub connectors, the pairs of opposed slider plates of the first and second sliders, the latter inside the former, being longitudinally slidable relative to each other between a telescopically-expanded position and a telescopically-contracted position, wherein the pairs of opposed slider plates of the first and second sliders, in the telescopically-expanded position, are inserted into the housing of the first connector from a direction traverse to a fitting direction of the first and second connectors, and the pair of opposed slider plates of the first slider, with the cam grooves of the first and second sliders engaged with the bosses of the second connectors, is pushed and moved to the telescopically-contracted position so as to make the pair of opposed slider plates of the second slider follow the pair of opposed slider plates of the first slider into the housing, whereby to fit the second connectors to the sub connectors of the first connector at staggered times.

The above and other objects, features and advantages of this invention will become apparent from the following description and the appended claims, taken in conjunction with the accompanying drawings.

DESCRIPTION OF THE PREFERRED EMBODIMENT

An embodiment of this invention will now be described with reference to the attached drawings.

Figure 1:
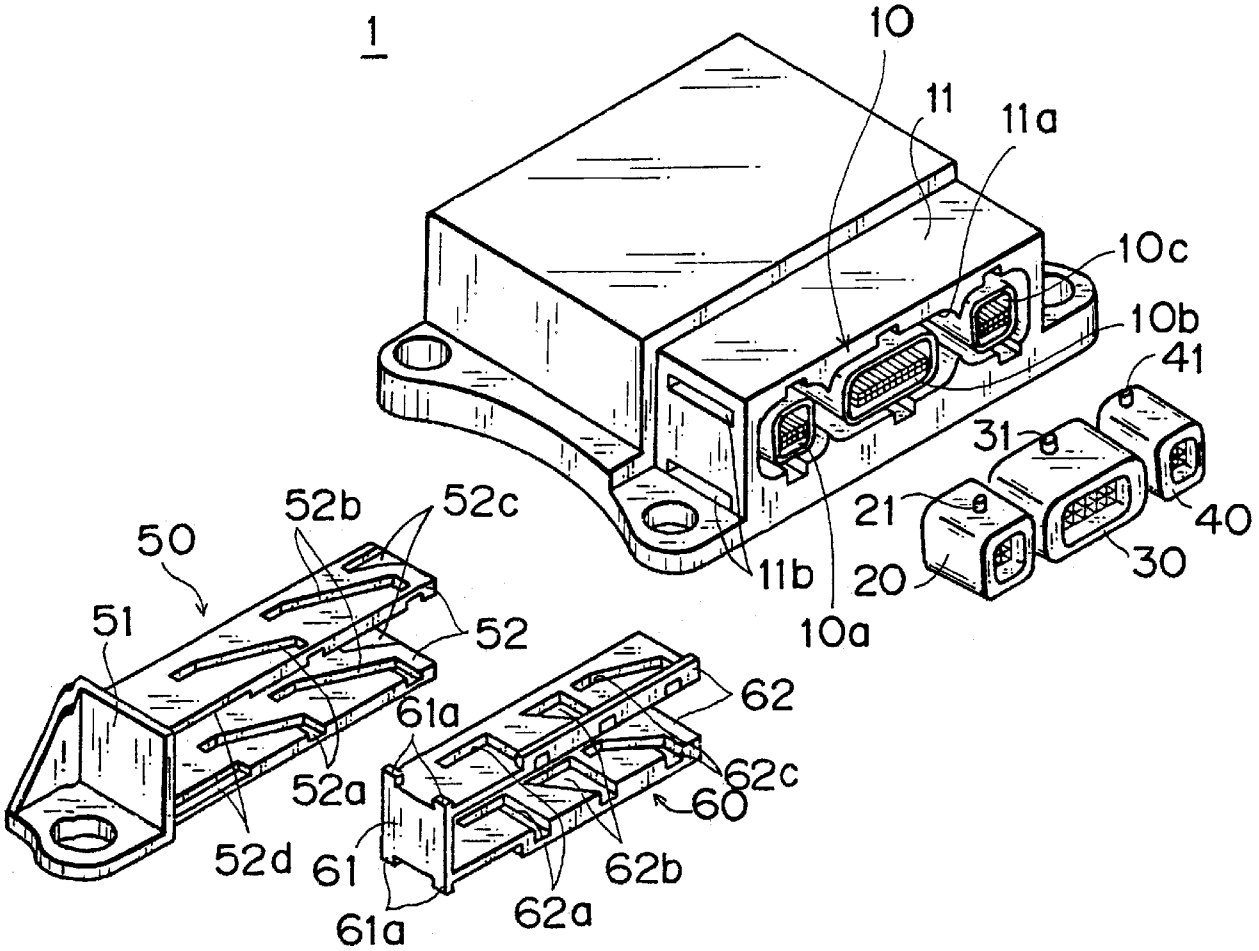
FIG. 1 is a separated perspective view of a low coupling force connector assembly according to one embodiment of this invention.

Referring to FIG. 1, a low coupling force connector assembly 1 of this embodiment consists of a female connector 10 provided on a device such as, for example, an electronic control unit (ECU), first to third male connectors 20, 30, 40, and a first and second sliders 50, 60. These constituent parts are all molded of synthetic resin to be of single-piece structure.

The female connector 10 has a housing 11 integral with the casing of the above-mentioned device and sub connectors 10*a*, 10*b*, 10*c* fixed in the housing 11, the housing opening to the front to receive the first to third male connectors 20, 30, 40. On its one side wall, the housing 11 has a pair of vertically-spaced insertion slits 11*b*, 11*b* for insertion therethrough of the first and second sliders 50, 60 into the receiving chamber 11*a*.

The first to third male connectors 20, 30, 40 each has a respective pair of bosses 21, 31, 41 projecting on its upper and lower walls. As will be described later, because in the present embodiment two cam grooves 52*a*, 52*b* are formed on the first slider 50, at different distances from the front edge of the first slider (the edge in a width direction of the first slider toward the male connectors), the bosses 21, 31 of the first and second male connectors 20, 30 corresponding to the cam grooves 52*a*, 52*b* are likewise located at rearward and forward positions on the first and second connectors 20, 30, respectively.

The first and second sliders 50, 60 are of different sizes and combined in use such that the second slider 60 is longitudinally slidable inside the first slider 50 in a telescopic manner. The first slider 50 serves to fit the first and second male connectors 20, 30 to the female connector 10 (sub connectors 10*a*, 10*b*), and the second slider 60 serves to fit the third male connector 40 to the female connector 10 (sub connector 10*c*).

Figure 2A:
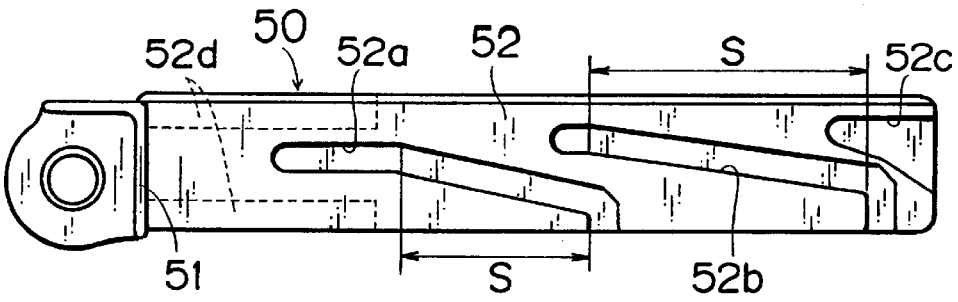
FIGS. 2A and 2B are a plan and side views, respectively, of a first slider of the connector assembly in FIG. 1.
Figure 2B:
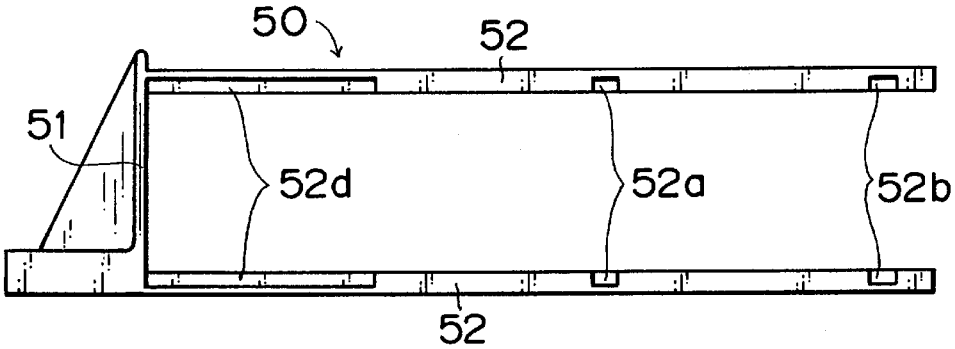

As shown in FIGS. 1 to 2B, the first slider 50 includes a side wall 51 and a pair of opposed slider plates 52, 52 extending in parallel at the upper and lower ends of the side wall 51. The slider plates 52 have formed thereon the cam grooves 52*a* for the bosses 21 of the first male connector 20, the cam grooves 52*b* for the bosses 31 of the second male connector 30, and non-interference cutouts 52*c* which overlap respective cam grooves 62*c* of the second slider 60.

The cam grooves 52*a*, 52*b*, which are formed in a longitudinally spaced arrangement, extend from the front edge of the slider plates 52 in a generally slanting manner toward the side wall 51 and, as mentioned above, are located at different distances from the front edge of the slider plates 52, the cam grooves 52*a* being generally located closer to the front edge. This arrangement allows an effective use of the cam-groove-forming space on the slider plates 52 so that the cam grooves 52*a*, 52*b* are provided with an elongated effective drive stroke S and at a less-steep slant angle.

In the present embodiment, the cam grooves 52*a* has a steeper slant angle than the cam grooves 52*b* so that the first male connector 20 is fitted, prior to the second male connector 30, to the female connector 10.

The non-interference cutouts 52*c* are provided at that part of the slider plates 52 which overlaps the cam grooves 62*c* of the second slider 60 so as to prevent interference of the slider plates 52 with the bosses 41 of the third male connector 40 during the bosses 41 being guided along the cam grooves 62*c*.

A pair of slide grooves 52*d*, 52*d* are provided on the inner surface of each slider plate 52 to extend in parallel from the side of the slider plate 52 where the side wall 51 is located, to provide a total of four slide grooves 52*d*, 52*d* (52*d*, 52*d*). A further description of these slide grooves 52*d*, 52*d* will be made later in connection with the second slider 60.

Figure 3A:
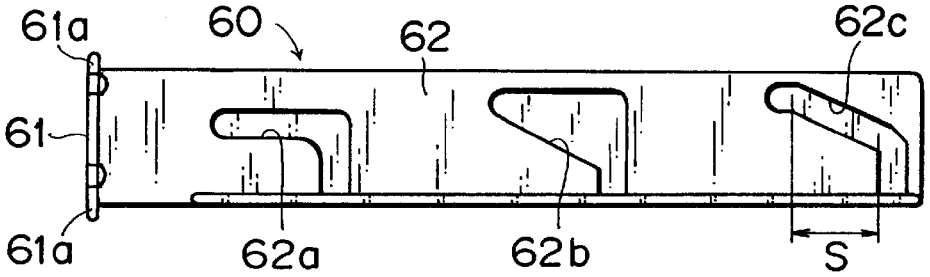
FIGS. 3A and 3B are a plan and side views, respectively, of a second slider of the connector assembly of FIG. 1.
Figure 3B:
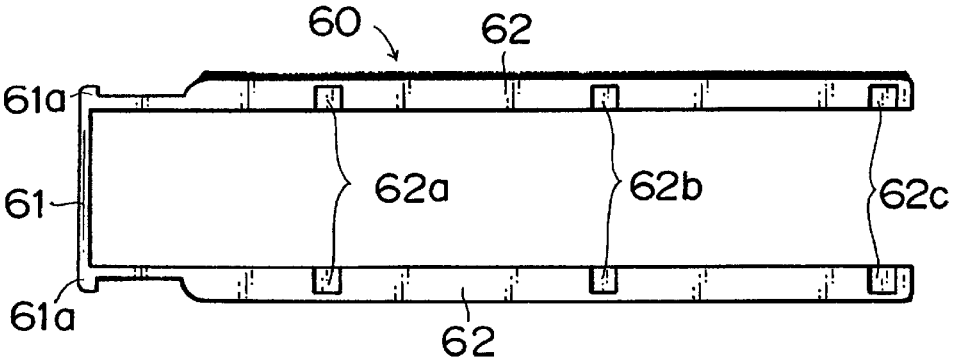

As shown in FIGS. 1, 3A and 3B, the second slider 60, like the first slider 50, includes a side wall 61 and a pair of opposed slider plates 62, 62 extending in parallel at the upper and lower ends of the side wall 61. The second slider 60 is fitted in between the slider plates 52, 52 of the first slider 50. The slider plates 62 have formed thereon interference cutouts 62*a* of substantially slit-like shape which overlap the cam grooves 52*a* of the first slider 50, interference cutouts 62*b* of substantially triangular shape which overlap the cam grooves 52*b* of the first slider 50, and the cam grooves 62*c* for the bosses 41 of the third male connector 40.

The non-interference cutouts 62*a*, 62*b* are provided at those parts of the slider plates 62 which overlap the cam grooves 52*a*, 52*b*, respectively, of the first slider 50 to prevent interference of the slider plates 62 with the bosses 21, 31 of the first and second male connectors 20, 30 during the bosses 21, 31 being guided along the cam grooves 52*a*, 52*b*.

The cam grooves 62*c* extend short in a longitudinal direction of the slider plates 62 as compared with the cam grooves 52*a*, 52*b* of the first slider 50 and slant at a steep angle so that, subsequent to coupling the first and second connectors 20, 30 by means of the first slider 50, the second slider 60, when moved by a short distance left for it to cover, may cause the third connector 40 to fit to the female connector 10.

The side wall 61 of the second slider 60 is provided at four corners thereof with vertically extending projections 61*a*, 61*a*, 61*a*, 61*a* which slidably engage in the respective slide grooves 52*d* of the first slider 50 mentioned above.

The second slider 60, when fitted inside the first slider 50, can slide in the longitudinal direction of the first slider 50 through the engagement of its projections 61*a* in the slide grooves 52*d*, so that the first and second sliders 50, 60 slide relative to each other in a telescopic manner by a distance corresponding to the length of the slide grooves 52*d*.

The side wall 51 side ends of the slide grooves 52*d*, in use, come into abutment against the projections 61*a* of the side wall 61 to make the second slider 60 follow the advancement of the first slider 50 into the housing 11 of the female connector 10.

The coupling and decoupling of the male and female connectors of the low coupling force connector assembly according the present embodiment will now be described with reference to FIGS. 1 and 4A to 6C.

Referring to FIG. 1, the first and second sliders 50, 60 are combined, with the second slider 60 drawn out in a telescopic manner from the first slider 50, so that the side walls 51, 61 are spaced from each other. The slider plates 52, 62 of the thus combined first and second sliders 50, 60 are then inserted through the insertion slits 11*b* into the housing 11 of the female connector 10.

Figure 4A:
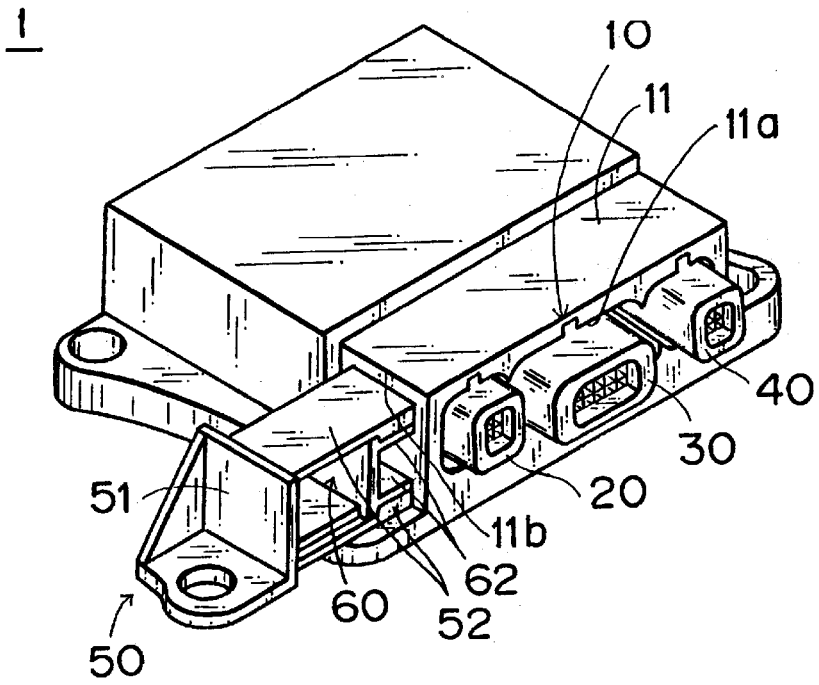
FIG. 4A is a perspective view of male connectors and a female connector of the connector assembly in FIG. 1, about to be coupled together.
Figure 5A:
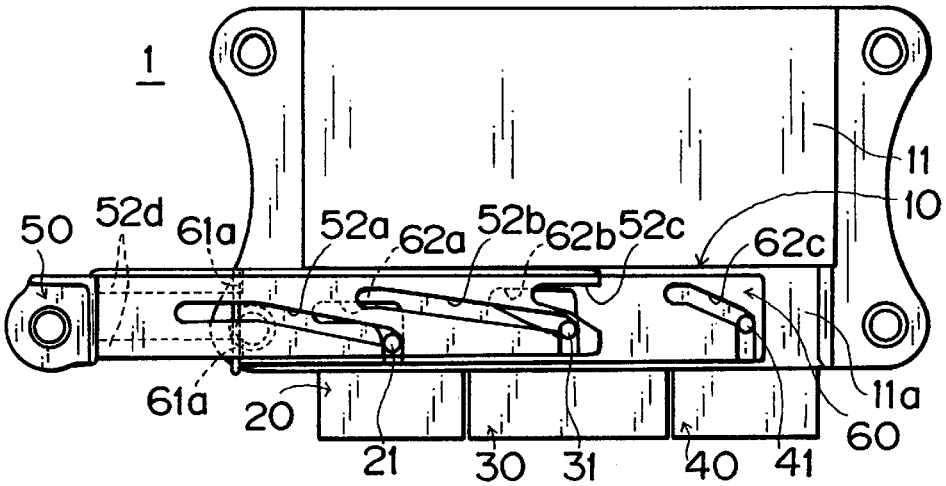
FIGS. 5A, 5B and 5C are a series of explanatory views of the action of the first and second sliders in the process of coupling together the male connectors and the female connector.
Figure 5B:
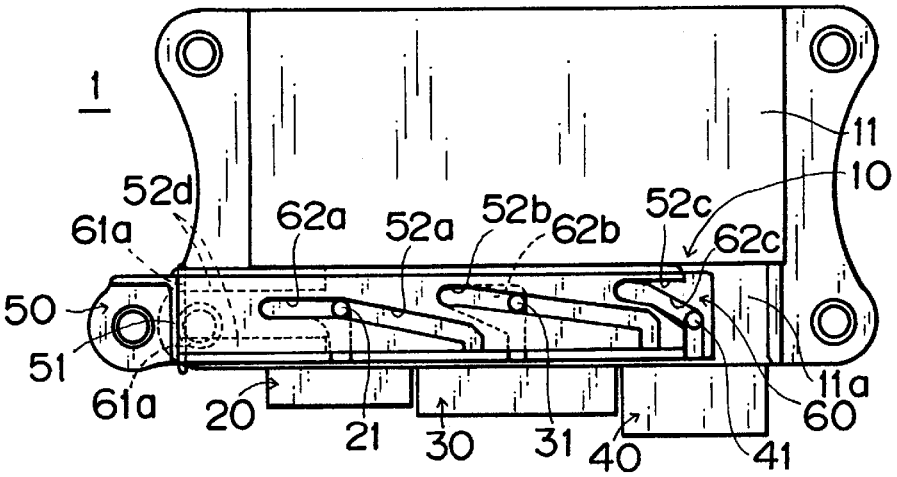

Thereafter, as shown in FIGS. 4A and 5A, the first to third connectors 20, 30, 40 are set in the receiving chamber 11*a* of the female connector 10, with their bosses 21, 31, 41 introduced into the inlets of the respective cam grooves 52*a*, 52*b*, 62*c* of the first and second sliders 50, 60 as well as in the inlets of the non-interference cutouts 62*a*, 62*b* of the second slider 60 overlapping the cam grooves 52*a*, 52*b*.

The first slider 50 alone is then pushed into the housing 11 of the female connector 10 to move the bosses 21, 31 along the respective cam grooves 52*a*, 52*b* of the first slider 50, at which time because the cam grooves 52*a* slant at a steeper slant angle than the cam grooves 52*b*, the first male connector 20 is drawn, prior to the second male connector 30, into the receiving chamber 11*a*.

During the above, the projections 61a slide in the slide grooves 52*d* so that the side wall 51 side ends of the slide grooves 52*d* abut against the projections 61a to thereby push the second slider 60, along with the first slider 50, deeper into the housing 11 of the female connector 10, at which time the bosses 41 of the third male connector 40 slide along the cam grooves 62*c* of the second slider 60 to draw the third male connector 40 into the housing 11*a* at a time delayed from the times when the first and second male connectors 20, 30 are drawn into the receiving chamber 11*a*.

Figure 4B:
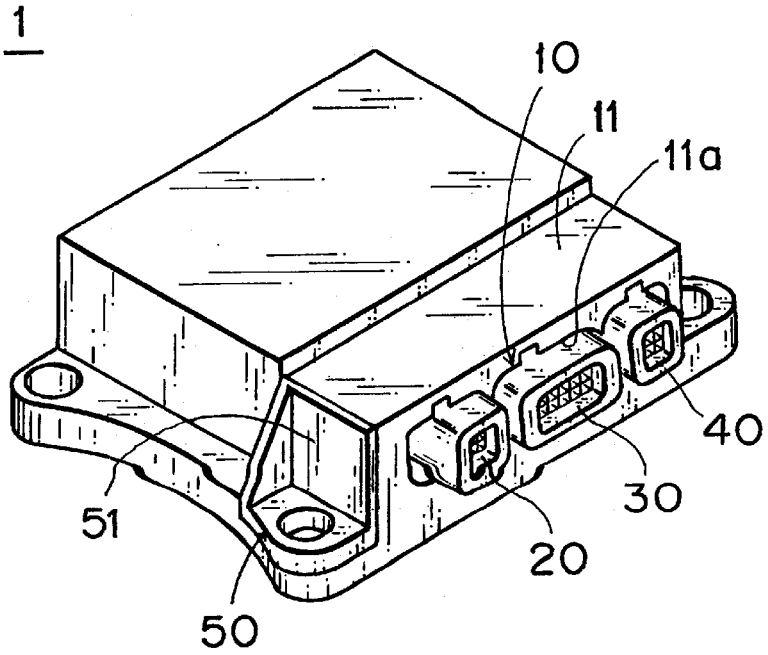
FIG. 4B is a view similar to FIG. 4A, showing the male connectors and the female connector fully coupled together.
Figure 5C:
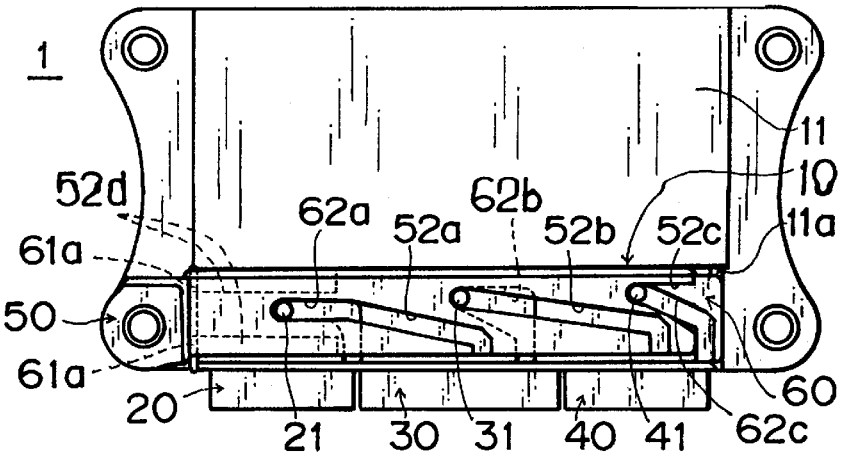

Then, on fully pushing the first and second sliders 50, 60 into the housing 11 of the female connector 10 as shown in FIGS. 4B and 5C, the first to third male connectors 20, 30, 40 are fully coupled with the respective sub connectors 10*a*, 10*b*, 10*c* in the receiving opening 11*a*.

Figure 6A:
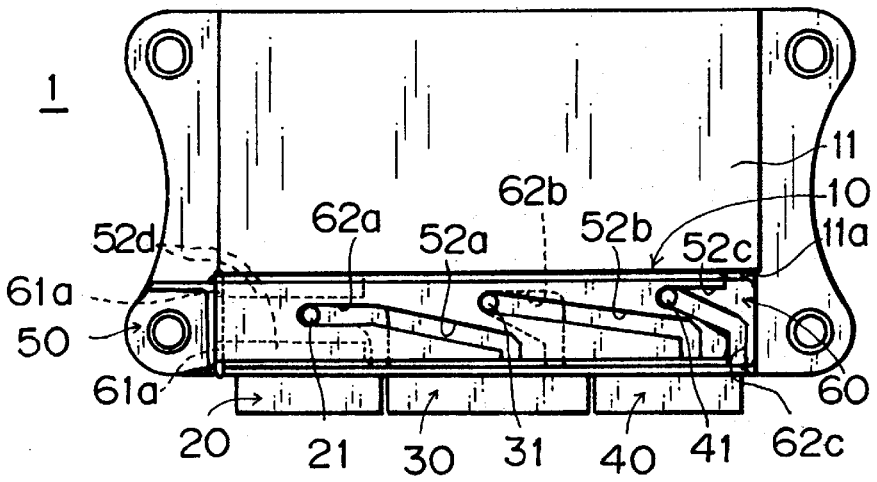
FIGS. 6A, 6B and 6C are a series of explanatory views of the action of the first and second sliders in the process of decoupling the male connectors from the female connector.
Figure 6B:
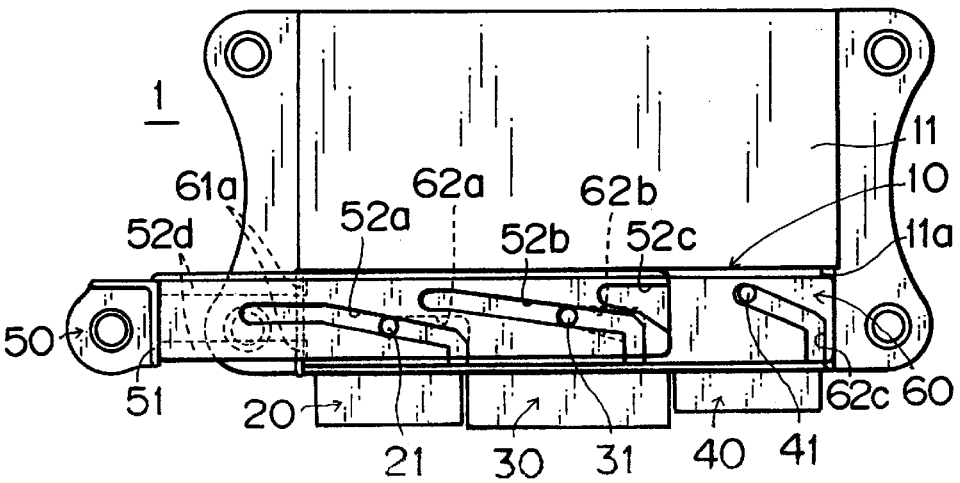

In order to detach the first to third connectors 20, 30, 40 from the female connector 10, the first slider 50 is first drawn from the housing 11 of the female connector 10, i.e., from the position as shown in FIG. 6A, with the second slider 60 left unmoved, so that the bosses 21, 31 slide along the respective cam grooves 52*a*, 52*b* of the first slider 50 as shown in FIG. 6B to push the first and second male connectors 20, 30 in a direction apart from the female connector 10, and that the projections 61*a* of the second slider 60 abut against the distal ends of the respective slide grooves 52*d* of the first slider 50, with the result that the second slider 60 starts to be drawn out in conjunction with the first slider 50. Consequently, the bosses 41 slide along the cam grooves 62*c* of the second slider 60 to push the third male connector 40 in a direction out of the female connector 10 at a time delayed from the first and second male connectors 20, 30.

Figure 6C:
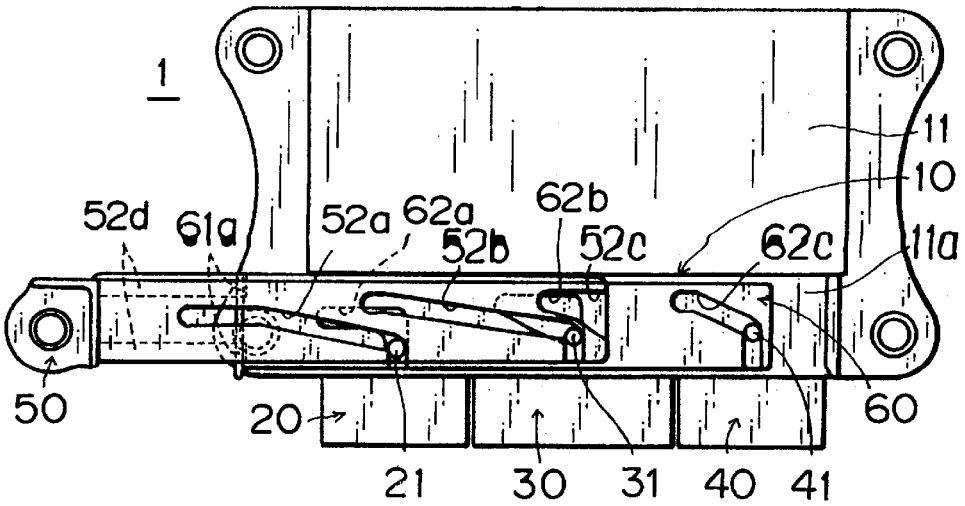
Figure 7A:
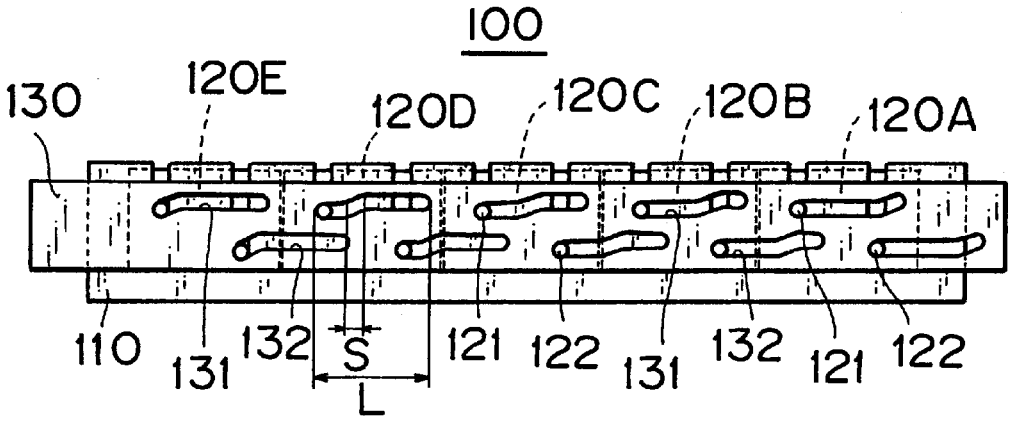
FIG. 7A PRIOR ART
FIG. 7A is a general side view of a conventional low coupling force connector assembly.
Figure 7B:
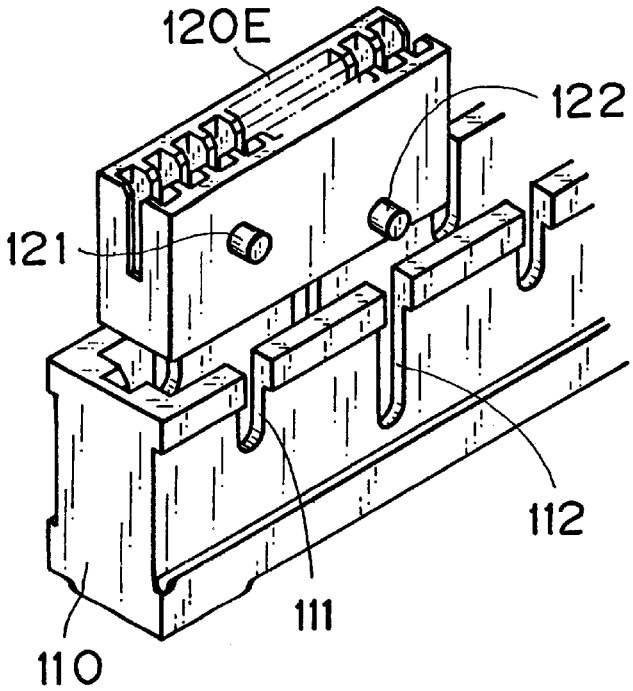
FIG. 7B PRIOR ART
FIG. 7B is a partial enlarged view of the conventional connector assembly in FIG. 7A.

When the first slider 50, along with the second slider 60, is drawn out of the housing 11 of the female connector 10 up to the position shown in FIG. 6C, it becomes possible to remove the first to third male connectors 20, 30, 40 from the female connector 10.

With the construction as mentioned above, because a plurality of sliders 50, 60 are employed, a wide space can be secured on each slider for forming the cam grooves 52*a*, 52*b*, 62*c*. As a result, the cam grooves 52*a*, 52*b*, 62*c* can be formed with an elongated effective drive stroke S and at a less-steep slant angle, leading to a reduced force required for operating the sliders 50, 60.

Because it is arranged that the plurality of sliders 50, 60 are operated at staggered times, the male connectors 20, 30, 40 are coupled with the female connector 10 at staggered times, also contributing to a reduction in the force required for operating the sliders 50, 60.

Because the sliders 50, 60 become shortened in a telescopic manner when pushed into the housing 11 of the female connector 10, the sliders and thus the connector assembly can be downsized.

Because the cam grooves 52*a*, 52*b* are formed on each slider plate 52, at different distances from the front end of the slider plate (the end in a width direction of the slider plate toward the male connectors 20, 30), an effective use of the space on the same slider plate 52 can be made, so that the cam grooves 52*a*, 52*b* are formed with an elongated effective drive stroke S and at a less steep slant angle, leading to a reduction in the force required for operating the slider 50 even when the slider has two cam grooves 52*a*, 52*b* formed thereon.

Because non-interference cutouts 52*c*, 62*a*, 62*b* are formed in the slider plates 52, 62, an interference of the slider plates 52, 62 with the bosses 21, 31, 41 of male connectors 20, 30, 40 during their sliding along the cam grooves 52*a*, 52*b*, 62*c* can be prevented, leading to a smooth operation of the sliders 50, 60.

The low coupling force connector assembly of this invention should not be construed as limited to the embodiment as described above. For example, while in the embodiment, there are employed two telescopic sliders 50, 60 for three male connectors 20, 30, 40, it is also possible to use three or more sliders for three or more male connectors.

Having now fully described the invention, it will be apparent to one of ordinary skill in the art that many changes and modifications can be made thereto without departing from the spirit and scope of the invention as set forth herein.

What is claimed is:

1. A low coupling force connector assembly comprising:

a first connector having a housing with a plurality of sub connectors fixed therein;

a plurality of second connectors, each having a boss means, corresponding to said sub connectors; and a first and second sliders, each having a cam groove means which guides therealong said boss means of a respective one or ones of said second connectors to fit said second connectors to said sub connectors, said first and second sliders, the latter inside the former, being longitudinally slidable relative to each other between a telescopically-expanded position and a telescopically-contracted position, wherein said first and second sliders, in said telescopically-expanded position, are inserted into said housing of said first connector from a direction traverse to a fitting direction of said first and second connectors, and said first slider, with said cam groove means of said first and second sliders engaged with said boss means of said second connectors, is pushed and moved to said telescopically-contracted position so as to make said second slider follow said first slider into said housing, whereby to fit said second connectors to said sub connectors of said first connector at staggered times.

2. The low coupling force connector assembly according to claim 1, wherein said cam groove means of at least one of said first and second sliders comprises two or more cam grooves in a longitudinally-spaced arrangement.

3. The low coupling force connector assembly according to claim 2, wherein said two or more cam grooves are located at different distances from an end in a width direction of said related slider or sliders toward said second connectors, and said boss means of said second connectors are correspondingly located at different distances from ends of said related second connectors toward said first connector.

4. The low coupling force connector assembly according to claim 3, wherein said two or more cam grooves are located closer to said end in the width direction of said related slider or sliders in order of proximity to a proximal end of said related slider or sliders.

5. The low coupling force connector assembly according to claim 2, wherein said two or more cam grooves slant at slant angles which become steeper in order of proximity to a proximal end of said related slider or sliders.

6. The low coupling force connector assembly according to claim 1, wherein at least one of said first and second sliders has a cutout formed therein at a position corresponding to said cam groove means of the other slider to avoid interference of said one of said first and second sliders with said boss means of one of said second connectors during its sliding along said cam groove means of said the other slider.

7. The low coupling force connector assembly according to claim 1, wherein one of said first and second sliders has a projection means, and the other slider has a corresponding slide groove means in which said projection means slides to move said first and second sliders relative to each other within limits of an entire length of said cam groove means.

8. A low coupling force connector assembly comprising:

a first connector having a housing with a plurality of sub connectors fixed therein;

a plurality of second connectors, each having an upper and lower bosses projecting thereon, corresponding to said sub connectors; and a first and second sliders, each having a pair of opposed slider plates with one or more pairs of opposed cam grooves formed thereon, said cam grooves guiding therealong said bosses of a respective one or ones of said second connectors to fit said second connectors to said sub connectors, said pairs of opposed slider plates of said first and second sliders, the latter inside the former, being longitudinally slidable relative to each other between a telescopically-expanded position and a telescopically-contracted position, wherein said pairs of opposed slider plates of said first and second sliders, in said telescopically-expanded position, are inserted into said housing of said first connector from a direction traverse to a fitting direction of said first and second connectors, and said pair of opposed slider plates of said first slider, with said cam grooves of said first and second sliders engaged with said bosses of said second connectors, is pushed and moved to said telescopically-contracted position so as to make said pair of opposed slider plates of said second slider follow said pair of opposed slider plates of said first slider into said housing, whereby to fit said second connectors to said sub connectors of said first connector at staggered times.

* * * * *